US005101518A

United States Patent [19]

Phillips

[11] Patent Number: 5,101,518

[45] Date of Patent: Apr. 7, 1992

[54] AUTOMATIC LOWERING DEVICE FOR TOILET SEAT

[76] Inventor: John M. Phillips, 4315 Valley Green Mall, Etters, Pa. 17319

[21] Appl. No.: 631,384

[22] Filed: Dec. 20, 1990

[51] Int. Cl.[5] ..... A47K 13/10

[52] U.S. Cl. ..... 4/251

[58] Field of Search ..... 4/248, 251

[56] References Cited

U.S. PATENT DOCUMENTS

| | | | |
|---|---|---|---|
| 2,214,323 | 9/1940 | Carter | 4/251 |
| 2,849,728 | 9/1958 | Gyllenberg | 4/251 |
| 3,284,810 | 11/1966 | Stokes | 4/251 |
| 3,781,924 | 1/1974 | Davis | 4/251 |
| 4,577,350 | 3/1986 | Clark | 4/251 |

*Primary Examiner*—Charles E. Phillips
*Attorney, Agent, or Firm*—Arthur J. Plantamura

[57] ABSTRACT

A mechanism is provided for automatically actuating the return of a conventional hinged toilet seat to the lowered position following a predetermined lapse of time after the toilet seat has been placed in the raised position.

The mechanism comprises a timing means to measure the lapse of predetermined period of time which is begun by the raising of a toliet seat and an actuator interconnected with the timing means to move the raised toliet seat sufficiently to result in the lowering of the toilet seat after the expiration of a predetermined time period. The device is conveniently retrofitted for use with conventional toilet seats which are hingedly connected at the rear to the top rear of a toliet bowl.

6 Claims, 3 Drawing Sheets

FIG. 4
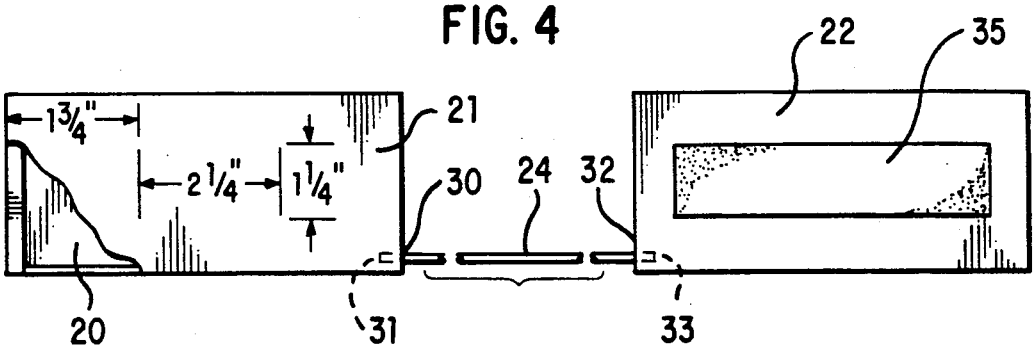
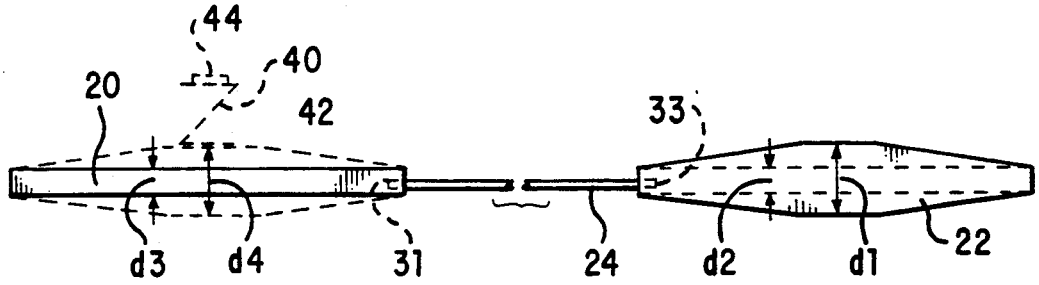
FIG. 4A
FIG. 5
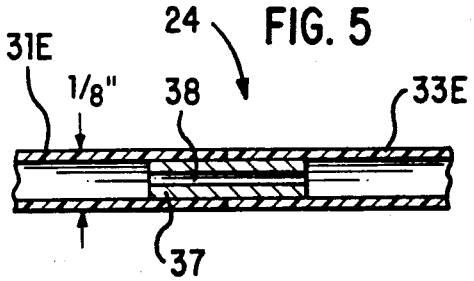
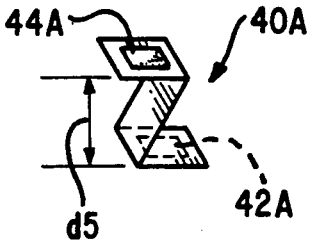
FIG. 6A
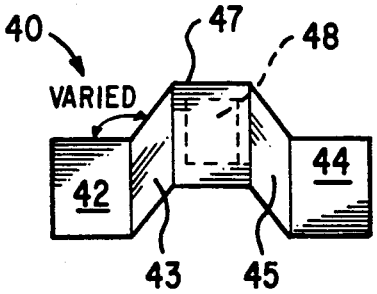
FIG. 6

AUTOMATIC LOWERING DEVICE FOR TOILET SEAT

This invention relates to an activating mechanism for lowering a toilet seat which has been lifted to the raised position and, more particularly, to a mechanism which is attached to a conventional toilet seat for the purpose of automatically lowering the toilet seat, following a predetermined lapse of time after the toilet seat has been placed in the raised position.

BACKGROUND OF THE INVENTION

A means has long been wanting, particularly by the female populations of households, for an answer to the annoying practice by males using household toilets, of leaving the toilet seat in a raised position after use. Undoubtedly various attempts have been made to obviate this annoyance. One such solution proposed is the use of an audible sound when a toilet seat has been raised, which persists until the seat is lowered. However, such a sound signaling device is in itself objectionable. Another device comprises a pedal with a linkage and lever device, which is stepped on by the male user of the toilet to raise the toilet seat and, when the foot of the user is lifted, the toilet seat is returned to the lowered position. Such devices, however, are relatively cumbersome and/or unsightly. Accordingly, a need exists for a relatively inexpensive, simple device for satisfactorily accomplishing the objective of returning a toilet seat, which has been raised, to the lowered position.

SUMMARY OF THE INVENTION

It is an object of the present invention to provide a novel device for returning a raised toilet seat to the lowered position.

It is a further and more particular object of the invention to provide a simple and economically practical device for automatically lowering a toilet seat, following a predermined lapse of time, after the toilet seat hase been placed in the raised position.

It is another object of the invention to provide an automatic mechanism which is reliable, easily retrofittable and inexpensive for lowering the toilet seat following a predetermined period of time after the toilet seat has been positioned in the raised position.

Additional objects and advantages of the invention will become apparent when considered in conjunction with the figures of the accompanying drawing of which the following is a brief description.

BRIEF DESCRIPTION OF THE DRAWING

FIG. 4 is an enlarged plan view of a preferred form of the actuating mechanism of the invention illustrating the component elements of the mechanism including: an actuator element or part that comprises an expandable sealed envelope or pouch, a reservoir element or part comprising a second expandable sealed envelope or pouch, and a flexible tubing connecting the interior of the two expandable sealed pouches.

FIG. 4A is an edge view of the arrangement shown in FIG. 4.

FIG. 5 is a detailed illustration of a segment of the flexible connecting tubing incorporating a connecting ferrule element which is inserted inside the ends of the tubing and has a restricted interior diameter to slow the passage of liquid therethrough.

FIG. 6 is one form of adaptor used in attaching the actuator part of the device of the invention to the underside of the toilet seat cover to provide for adjustable tolerance.

FIG. 6A is an alternative form of an adaptor for attaching the actuator element to the underside of the seat cover and providing adjustable tolerance between the actuator and the seat.

DETAILED DESCRIPTION OF THE INVENTION

The novel mechanism of the invention is advantageously devised to automatically lower a toilet seat of the conventional kind which is secured to a toilet bowl by a hinge arrangement at the rear of the seat and at the top rear of the bowl.

In accordance with the invention, a novel mechanism is provided which engages the toilet seat, and when the seat has been pivoted in the elevated position and a predetermined period of time, e.g., about 1 to 3 minutes, has elapsed, functions to automatically return the toilet seat to the lowered position. The actuating mechanism may comprise a hydraulic system or, in the alternative as described in more detail hereinafter, the actuating mechanism may comprise a mechanical or an electrical actuating means.

Figure 1:
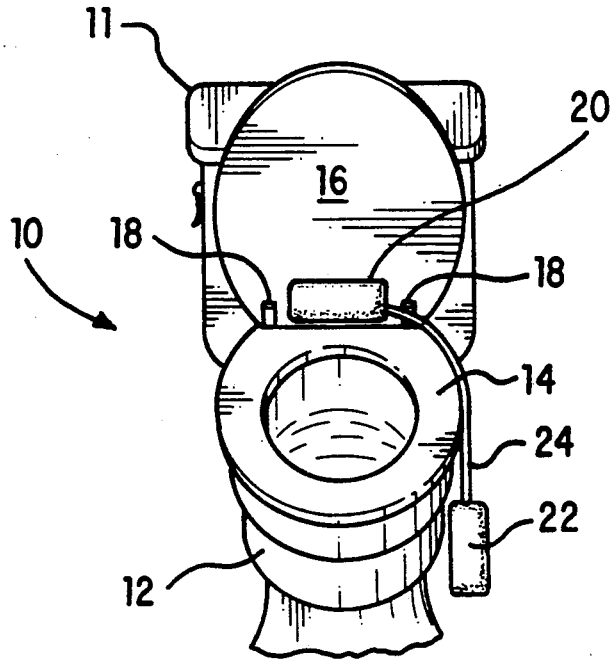
FIG. 1 is a perspective illustration showing one form of the device of the invention which is hydraulic in character and is partially installed with the actuator part of the device of the invention attached to the toilet seat cover.

Referring to the form of the invention illustrated in FIGS. 1–6 of the drawing, FIG. 1 illustrates a conventional toilet 10 including a bowl 12, a seat 14, and seat cover 16, the seat 14 and seat cover 16 being hingedly connected at 18 to the bowl 12 in a conventional manner. Shown attached on the lower part of the underside of the seat cover 16 is the actuator part 20 of the automatic lowering device of the invention. When the seat 14 is raised to the elevated position, the actuator element 20 is sandwiched between the lower part of the underside of the seat cover 16 and the lower part of the upper side of the raised seat 14. A second part 22 comprising a reservoir of the automatic lowering device is shown hanging unattached in FIG. 1. and being connected to the actuator 20 by a flexible tubing 24. The interaction of the parts 20 and 22 and the flexible connecting tubing 24 will be described in operative detail hereinafter.

Figure 2:
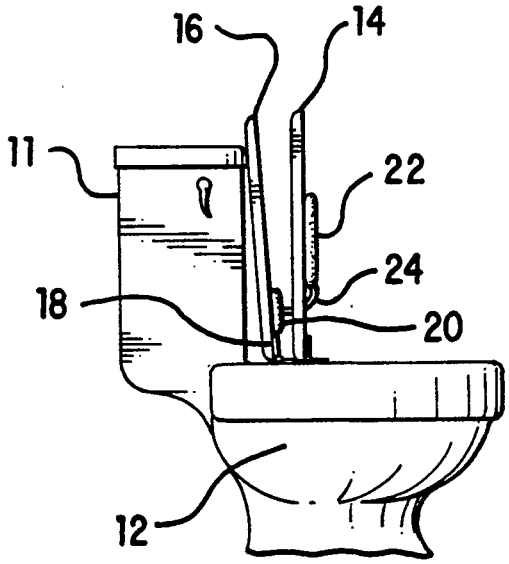
FIG. 2 is a side view of the actuating mechanism showing the form of the invention as shown in FIG. 1 in which both parts of the device are in position, the actuator part being attached to the underside of the seat cover and a reservoir part being secured to the underside of the seat.

As shown by the side view of FIG. 2, the actuator element 20 is sandwiched near the bottom of and between the raised seat cover 16 and seat 14. In FIG. 2, the reservoir element 22 connected to the acutator element 20 by the flexible tubing 24 is shown attached to the underside of the seat 14 at an elevation (when the seat cover 14 and cover 16 are in a raised position) higher than the position of the actuator 20. When so disposed, liquid in reservoir 22 flows by gravity through the flexible tubing 24 into the actuator element 20 thereby decreasing the liquid volume in the reservoir 22 and increasing the liquid volume in the actuator 20.

Figure 3:
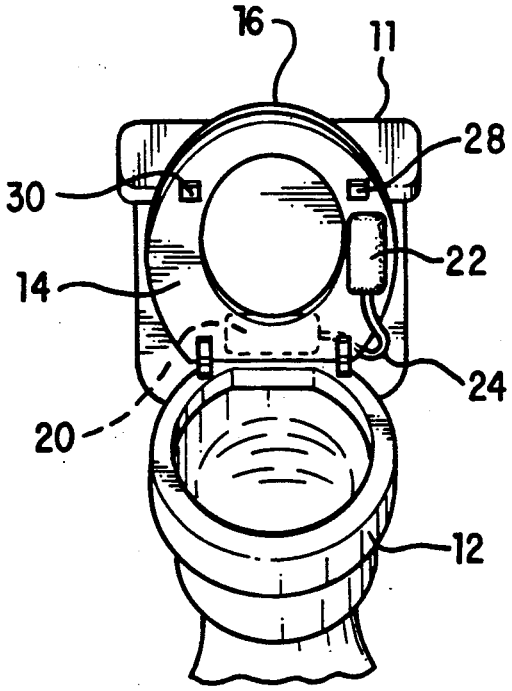
FIG. 3 is a front view showing the device illustrated in FIGS. 1 and 2 wherein both the toilet seat cover and the toilet seat are raised and showing the reservoir portion of the device of the invention attached to the underside of the seat and connected by means of a flexible tubing to the actuator portion (shown in broken line) which is secured to the underside of the seat cover.

FIG. 3 illustrates in a frontal view the arrangement shown in FIG. 2. The actuator 20 that is attached to the seat cover 16 is sandwiched between the seat 14 and seat cover 16 and is shown in broken line in FIG. 3 (being behind the raised toilet seat). The underside of the seat is provided with bumper elements 28 which preferably are formed of a resilient composition such as a relatively soft rubber to better cushion the sound and shock of the seat when it is moved from the raised position and drops to the lowered position. Bumpers 28 may replace the bumpers provided with the seat 14 or may supplement the conventional bumbers already fitted on the toilet seat and may be affixed thereto by means of a self-stick adhesive.

The actuator mechanism described with reference to FIGS. 1-3 is shown in greater detail by reference to FIG. 4. As seen therein, the system which is hydraulic in character comprises a sealed system in which liquid flows by gravity back and forth from one expandable pouch through a flexible tubing to the other expandable pouch. The direction of liquid flow depends on which sealed pouch is at the higher elevation. As shown in FIG. 4 one sealed expandable envelope or pouch 20 performs as the actuator and the second pouch or envelope 22 functions as a liquid reservoir. The two sealed flexible envelopes 20 and 22 are connected by a flexible tubing 24 whose ends 31 and 33, respectively, are inserted into and sealed at the ends 30 and 32, respectively of the sealed envelopes to provide a closed system wherein the liquid is contained in and can flow back and forth between the envelopes. The liquid contained in the envelopes 20 and 22 and passing through the tubing 24 is essentially sealed in a leak proof system. Both of the envelope-like pouches 20 and 22 are similar and comprise sealed expandable envelopes devised to confine a liquid. These envelopes may be regarded as similar to miniature hot water bottles which expand when liquid is introduce therein and flatten when liquid is withdrawn therefrom. Any suitable transfer liquid, preferably a non toxic liquid such as water, or water with a minor quantity of a disinfectant additive, such as chlorine may be used. Other suitable transfer liquids, i.e., liquids which flow back and forth through tubing 24 to pouches 20 and 22, such as polyethylene glycol may also be used.

The pouches 20 and 22 are formed of a suitable pliable but tough synthetic resinous composition, preferably heavy gauge sheeting that is liquid impermeable such as a vinyl plastic, e.g., of a kind that is commercially available and often used as a swimming pool liner material and which permit the pouches to expand when filled with a liquid and to flatten when liquid is withdrawn therefrom.

As shown in FIG. 4, the actuating mechanism comprises the sealed acutator pouch 20 and the sealed reservoir pouch 22. Secured in the inside to one end 30 of the actuator 20 is one end 31 (shown in broken line) of the flexible tubing 24. The other end 33 (also in broken line) of the flexible tubing 24 is similarly partially embedded within and at the end 32 of the reservoir pouch 22.

To secure the actuator pouch 20 on the underside of the toilet seat cover, and the reservoir pouch 22 on the underside of the seat, any suitable means may be employed. A preferred arrangement comprises a double face adhesive strip such as that shown as 35 in FIG. 4. Thus, the unit may be provided with the double face adhesive strip 35 on one side adhered to the pouch 22 and the other face of the strip 35 after peeling off a conventional film strip over the adhesive the pouch 22 is then attached to the underside of the seat 14. To accomodate variations in the distance, i.e., the space, between the seat cover 16 and the seat 14 (see FIG. 2), a suitable adaptor 40 such as that shown in FIG. 6 is provided. The adaptor 40 permits an adjustment to provide a tolerance for maximum efficiency by the actuator pouch 20 when it is sandwiched between the raised seat cover 16 and the raised seat 14. The adaptor 40 shown in FIG. 6 comprises a strip of medium gauge aluminum contoured in a symetrical configuration and having a central face portion 47 which is secured by any suitable means to the underside of the seat cover 16 such as by a double faced foam adhesive strip. The two wing portions 42 and 44 of the adaptor fit into slots cut into a suitable cover 21 which is placed over the pouch 20. The cover 21 is preferably color coordinated with the color of the toilet seat and seat cover. To vary the distance of the actuator pouch from the seat cover bottom, the adaptor 40 is bent so as to have a greater angle between panels 42 and 43 and between 44 and 45 thereby providing for narrower distances in space between the toilet seat cover and toilet seat. For a larger distance, these panels are bent so as to have a more acute angle.

The flexible tubing 24 through which the liquid flows back and forth between the interior of the sealed actuator pouch 20 and the interior of the sealed reservoir pouch 24 is illustrated in more detail by reference to FIG. 5. As shown therein, the end 31E of the flexible tubing 24 leading from the actuator 20 and the end 33E of the flexible tubing 24 leading from the resevoir 22 may be suitably connected by a metal ferrule 37 of suitable metal, e.g. brass that is inserted by a sealed fit in the ends 31E and 33E. The interior diameter 38 of the ferrule 37 is selected to suitably restrict the flow of liquid so that the passage of the desired amount of liquid from the resevoir 22 to the actuator 20 consumes the predetermined time lapse of about 2 minutes.

The functioning of the form of the device of the invention illustrated in FIGS. 1-4 is further described by reference to FIG. 4A. The device is installed as described above with the acutator pouch 20 attached to the underside of the seat cover 16 and the reservoir pouch 22 attached to the underside of the seat 14. When the seat 14, or the seat 14 and the seat cover 16, are in the lowered position, i.e., closed, the liquid drains into the resevoir pouch 22 such that the diameter d1 thereof (shown by the solid line) is substantially expanded. When the seat 14 is positioned upright, i.e., raised, as illustrated in FIGS. 1 and 2, this elevates the reservoir pouch 22 to a level above the level of the actuator pouch 20. As a consequence, the liquid contained the the reservoir 22 flows into the end 33 of flexible conduit 24 and enters the actuator pouch 20 through the end 31 of the flexible tubing 24 expanding the diameter of actuator pouch 20 from d3, the solid line configuration of pouch 20 to diameter d4, the broken line configuration of actuator pouch 20. The expansion of the actuator pouch 20 which is sandwiched the seat 14 and the seat cover 16 (see FIG. 2) is sufficient to push the raised seat forward to initiate lowering of the hinged seat 14 sufficiently to a point where the gravity of the weight of the seat 14 effects movement (dropping) of the seat 14 to the lowered position. When the seat has been lowered, this then begins a return flow of the liquid from the actuator pouch which is now at a relatively higher level, to the reservoir pouch 22, which is at a relatively lower elevation. It is thus seen that the liquid collects in the reservoir pouch 22 when either the seat 14 or both the seat 14 and the seat cover 16 are closed, i.e., in the lowered position.

Also shown in FIG. 4A in broken line is an adaptor 40 which is an alternative to the adaptor described by reference to FIG. 6. Referring to FIG. 6A, the adaptor 40 comprises a Z-shaped element formed of a suitable bendable material such as a suitably heavy gauge metal, e.g., aluminum, whose configuration i.e. the distance between the upper face and lower face can be changed by bending to provide the desired distance d5. The adapter 40 is sufficiently bent so that the actuator 20, when it is in an essentially flat condition, i.e., substantially empty of liquid, and has the diameter d3 (FIG. 4), fits snugly without significant pressure between the seat cover 16 and the seat 14 (FIG. 2). The Z-shaped adaptor is appropriately secured such as by using a conventional double sided adhesive foam tape at one end 42 to secure the adaptor the the actuator 20 and at the other end by using a similar double sided adhesive tape 44 to secure the unit to the seat cover 16. The adaptor 40 of FIG. 6A is illustrated by phantom lines on FIG. 4A.

Figure 7:
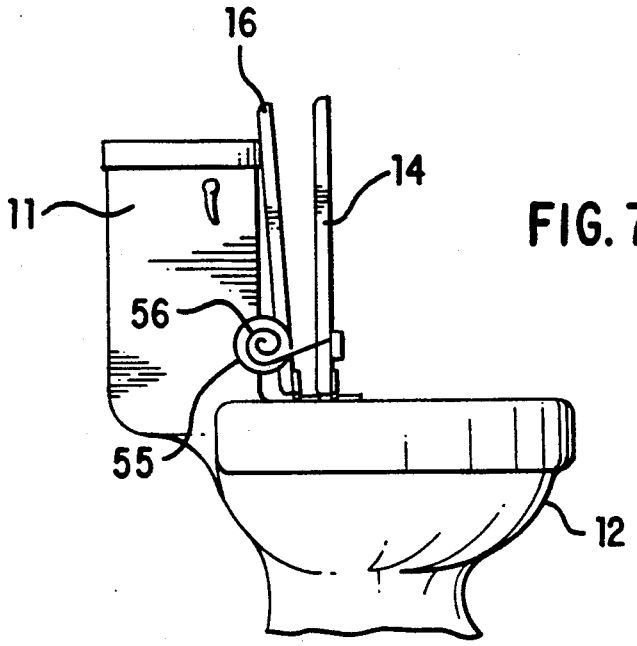
FIG. 7 is an alternative form of the actuating mechanism of the invention whereby the initiation of movement effecting the seat closure is a mechanical timing unit as distinguished from the hydraulic means of the device illustrated in FIGS. 1–6.
Figure 8:
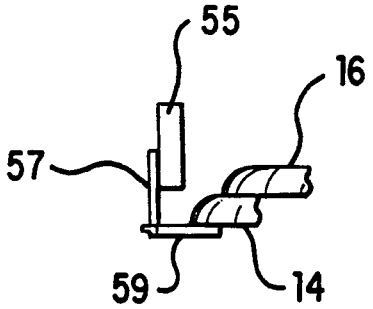
FIG. 8 is another view of the mechanical timing device illustrated in FIG. 7.

In an alternative embodiment, the actuating mechanism of the invention, instead of using a hydraulic flow device uses instead a mechanical device comprising a spring-wound timer 55 and lever 57 arrangement. In this mechanical device, as shown by reference to FIGS. 7 and 8, when the toilet seat 14 is raised a spring 56 is wound to provide a predetermined time lapse, e.g., about 2 minutes. When this predetemined time period has elasped, the unwound spring triggers a link 57 which presses against a lever 59 secured to the underside of the seat cover with a sufficient pressure to initiate the movement of the raised seat to a point where (as in the hydraulic embodiment of FIGS. 1–6) the weight of the pivotable seat drops the seat to the lowered position. The mechanical timer mechanism is similar to those of household dial timers which are well known to those skilled in the art and are commercially available. This alternative embodiement is shown schematically by reference to FIGS. 7 and 8.

Figure 9:
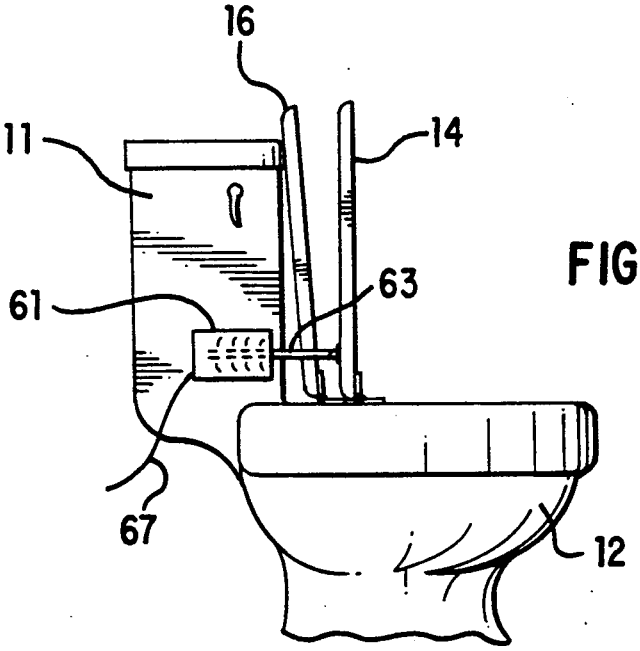
FIG. 9 illustrates still a further alternative embodiment in which the actuating means triggering the lowering of the raised toilet seat after a predetermined time lapse employs an electrically actuated solenoid.
Figure 10:
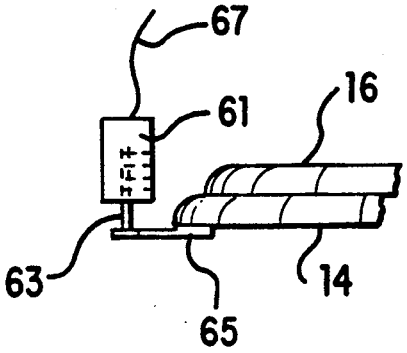
FIG. 10 is another view of the electrically triggered device illustrated in FIG. 9.

A further alternative embodiment comprises a solenoid arrangement which requires a very low power requirement that may be supplied either by a DC or AC source. The AC source may be derived, in those toilet seat installations which incorporate an electrical seat warmer(not shown) from the same source of electricity. In essence, this alternative embodiment is illustrated by reference to the schematic arrangements of FIGS. 9 and 10 and essentially comprise a timer actuated solenoid 61 connected to a suitable power source 67. The solenoid 61 is timed to arm, i.e., move, the solenoid piston 63 within a predetermined time lapse after the seat 14 is raised. The solenoid piston 63 upon being armed moves the lever 65 which is attached to the seat 14 a sufficient distance to initiate the closing of the seat 14 by gravity. Solenoid devices of this kind are known in the art and are available commercially.

While I have shown and described my apparatus in detail, it is to be understood that the invention is to be limited only by the appended claims inasmuch as various changes may be made without departing from the spirit and scope of the invention.

What is claimed is:

1. A device for automatically initiating the lowering of a hinged toilet seat following a predetermined time lapse after the toilet seat has been placed in the raised position comprising:

(a) a timing means which measures a predetermined time period: and (b) an actuator, interconnected with said timing means:

said actuator being connected to a hinged toilet seat arranged to move the hinged toilet seat when the toilet seat is in the raised position and the actuator is triggered, said time measuring means being connected to said actuator and being intiated by the raising of the said toilet seat and upon expiration of said predetermined time period, initiating the movement of the actuator connected to the toilet seat, the said timing means comprising a sealed hydraulic arrangement including a first expandable acutator pouch capable of containing sealed therein a liquid, a second sealed expandable reservoir pouch capable of containing sealed therein a liquid and being interconnected by a means of a flexible conduit to said first pouch, said flexible conduit having a passage which restricts flow to provide a desired, predetermined flow time for the liquid from the reservoir pouch to the actuator pouch, said reservoir pouch being affixed to the toilet seat so that it is at an elevation higher than the actuator pouch when the toilet is raised and at an elevation lower than the actuator pouch when the toilet seat is lowered.

2. The device of claim 1 wherein the actuator pouch attached to the toilet seat cover and the reservoir pouch attached to the toilet seat are secured by a self-stick tape.

3. The device of claim 1 including an adjustable distance adapter used in securing the actuator pouch to the underside of the toilet seat cover.

4. The device of claim 3 wherein the adapter has a Z-shaped configuration.

5. The device of claim 1 wherein the flexible conduit includes a flow restriction element to provide the desired liquid flow rate therethrough.

6. The device of claim 1 wherein the actuator pouch and the reservoir pouch are encased in an outer cover which is color coordinated with the toilet seat.

* * * * *